US005328284A

United States Patent [19]

Moeck et al.

[11] Patent Number: 5,328,284

[45] Date of Patent: Jul. 12, 1994

[54] REFILLING CONTAINER FOR REFILLING A WRITING, PAINTING OR DRAWING IMPLEMENT

[75] Inventors: Gerhard Moeck, Kirchehrenbach; Peter Krueckel, Heroldsberg, both of Fed. Rep. of Germany

[73] Assignee: Schwan-STABILO Schwanhaeusser GmbH & Co., Nuremberg, Fed. Rep. of Germany

[21] Appl. No.: 971,973

[22] PCT Filed: Aug. 20, 1991

[86] PCT No.: PCT/DE91/00663

§ 371 Date: Feb. 16, 1993

§ 102(e) Date: Feb. 16, 1993

[87] PCT Pub. No.: WO92/04195

PCT Pub. Date: Mar. 19, 1992

[30] Foreign Application Priority Data

Sep. 1, 1990 [DE] Fed. Rep. of Germany ..... 9012534
Dec. 12, 1990 [DE] Fed. Rep. of Germany ..... 9016777
Dec. 13, 1990 [DE] Fed. Rep. of Germany ..... 9016837

[51] Int. Cl.[5] ..... B43K 11/00

[52] U.S. Cl. ..... 401/119; 401/135; 401/196; 401/199; 141/20.5; 141/320; 141/321

[58] Field of Search ..... 401/195, 132, 196, 199, 401/135, 119; 141/20.5, 21, 349, 320, 321

[56] References Cited

U.S. PATENT DOCUMENTS 1,854,814 4/1932 Terry ..... 141/20.5 X
3,399,020 8/1968 Margolis et al. ..... 401/135

FOREIGN PATENT DOCUMENTS 937935 12/1955 Fed. Rep. of Germany ..... 141/20.5
3307448 9/1984 Fed. Rep. of Germany ..... 401/135

*Primary Examiner*—Steven A. Bratlie
*Attorney, Agent, or Firm*—Bachman & LaPointe

[57] ABSTRACT

Described is a refilling container for refilling a writing, painting or drawing implement, a cosmetic applicator implement or the like, wherein the implement (44) comprises an applicator member (48) which projects out of a casing and which has a capillary conveying action, for a fluid of relatively low viscosity, a reservoir for the fluid, which is in fluid communication with the applicator member (48), and a vent passage (78) in the vicinity of the applicator member (48). The refilling container (10) is provided with a neck portion (58). The implement (44) to be refilled can be inserted with its applicator member (48) and with a casing portion (46) adjoining the applicator member (48), into the neck portion (58) of the refilling container, in such a way that the neck portion (58) is sealed off by the casing portion (46) and a fluid communication is formed through the vent passage (78) between the refilling container (10) and the reservoir in the implement (44).

7 Claims, 4 Drawing Sheets

REFILLING CONTAINER FOR REFILLING A WRITING, PAINTING OR DRAWING IMPLEMENT

BACKGROUND OF THE INVENTION

The invention relates to a refilling container for refilling a writing, painting or drawing implement, a cosmetic applicator implement or the like, wherein the implement comprises an applicator member which projects out of a casing and which has a capillary conveying action for a fluid of relatively low viscosity, a reservoir for the fluid which is in fluid communication with the applicator member, and a vent passage in the vicinity of the applicator member.

In implements of that kind, the applicator member with its capillary conveying action may comprise a fibrous wick material or the like, which is suitable to provide for capillary conveying of the fluid which is stored in the reservoir of the implement. In that arrangement, the vent passage which is disposed in the vicinity of the applicator member is known to serve to avoid a reduced pressure which impedes or prevents the discharge of the fluid from the applicator member.

Hitherto implements of this kind were what are known as one-way or disposable implements which were thrown away after the fluid stored in the reservoir of the implement had been consumed. However that results in environmental pollution which cannot be ignored.

A refilling container of this kind which is intended in particular for writing implements, that is to say fountain pens, is known from DE-C-859 719. Therein the plug element is in the form of a tubular sleeve with a central opening therethrough so that a further element, namely a stopper, is required for sealing off the refilling container. The stopper has to be removed from the plug element when a writing implement is to be filled using the refilling container. That situation involves the problem that the stopper can be lost, whereupon the plug element and thus the refilling container can no longer be sealingly closed.

The object of the present invention is therefore that of providing a refilling container of the kind set forth above, which is suitable for refilling an implement, in a simple and time-saving manner, so that such an implement does not need to be thrown away when the fluid stored in its reservoir has been used up.

SUMMARY OF THE INVENTION

According to the invention that object is attained by the present invention wherein wherein a plug element is in the form of a cap-like closure plug which is oriented into a refilling container and which is slidably displaceable between a rest position of sealing off the refilling container and a refilling position providing a fluid communication between the interior of the refilling container and a receiving space which is open at one side.

The refilling container can be of a tube-like configuration so that it is simple to produce and can be easily filled with a suitable low-viscosity fluid. That results in an inexpensive refilling container for the purposes of refilling an implement of the kind set forth in the opening part of this specification. As the refilling container is handled only comparatively little, in comparison with the writing, painting or drawing implement or the like, the refilling container can be made from a material which is of thin gauge in comparison with the implement. That reduces the consumption of material, thus resulting in the available resources being saved. Furthermore that gives a reduction in the problems involved in eliminating refuse or garbage.

In the refilling container according to the invention, the neck portion and the closure element may be provided with screwthread portions which are suitably adapted to each other. In that arrangement, it has been found desirable for the neck portion to have an external screwthread portion, while the closure element has an internal screwthread portion which is adapted thereto.

It will be appreciated that the refilling container may also be of any other configuration, that is to say the neck portion and the closure element of the refilling container may be provided for example with bayonet closure members which are adapted to each other.

The refilling container is of another simple configuration if the closure element is in the fore of a plug or stopper which can be sealingly fixed to the neck portion. In that arrangement, the neck portion can be of a simple configuration, in comparison with a construction which has a screwthreaded portion or a bayonet closure member.

It is also possible for the neck portion to be closed by a closure foil which can be welded on to the neck portion.

So that the refilling container according to the invention can be used to fill different implements with the fluid stored in the refilling container, it is advantageous for the neck portion of the refilling container to be of an internal configuration which reduces from its open end towards the refilling container. In that arrangement the neck portion may be of a simple conical configuration on its inside, but it is also possible for the neck portion to be provided on its inside with axially successive spaces which are of such a configuration as to increase in a step-wise manner, from the refilling container towards the open end of the neck portion. Each space may be provided with a sealing lip extending therearound, in order to guarantee a reliable seal between the neck portion of the refilling container and the housing portion, from which the applicator member of the applicator implement projects, of the implement which is to be correspondingly refilled. The operation of filling an implement which is suitably inserted into the neck portion of the refilling container is effected either by virtue of the fact that the wall of the implement is of a suitably yielding configuration so that the wall of the implement can be repeatedly compressed in order to produce a suitable pump action, or the refilling container is repeatedly compressed in order to produce a suitable pump action, as a result of which fluid flows out of the refilling container, through the vent passage disposed in the vicinity of the applicator member, into the reservoir of the implement.

The neck portion of the refilling container according to the invention may be integrally formed or molded thereon and the refilling container may be sealed off at its end remote from the neck portion. Another configuration of the refilling container according to the invention is characterized in that the neck portion is provided at a first portion of the refilling container, which is sealingly connected to a second portion of the refilling container. Independently thereof, the refilling container is generally a simple and inexpensive tube-like container with which it is possible for a suitable implement of the above-indicated kind to be refilled with the fluid in the refilling container, after the fluid stored in the reservoir of the implement has been consumed. Therefore, after the fluid which is originally stored in the reservoir of the implement has been consumed, it is no longer necessary for the implement to be thrown away, thus avoiding environmental pollution.

In accordance with the invention it is possible to provide in the neck portion of the refilling container a cap-like closure plug or stopper which is oriented into the refilling container and which is displaceable slidably in the axial direction between a rest position in which it seals off the refilling container and a refilling position providing a fluid communication between the interior of the refilling container and a receiving space, which is open at one side, of the closure plug, wherein the receiving space of the closure plug, which space is open at one side, is provided for accommodating the applicator member and at the same time for sealingly receiving a portion of the casing of the implement to be filled, which casing portion is adjacent to the applicator member and has the vent passage.

In that respect the refilling container may comprise a transparent material so that it is readily possible to recognize the store of liquid therein, or the color of the liquid stored therein. The refilling container may have a storage volute which is at most equal to the volume of the reservoir of the implement to be filled. Preferably however the volume of the refilling container is considerably smaller than the volume of the reservoir of the implement to be filled. That refilling container also has the considerable advantage that it is only composed of two parts which are simple to produce and simple to fit together. With that refilling container, it is easily possible in a clean and tidy fashion to fill an emptied implement again with a suitable fluid of relatively low viscosity, within a short period of time. For that purpose, the implement to be filled is fitted with its applicator member leading into the receiving space in the closure plug, which is open at one side, until the collar-shaped portion of the casing of the implement to be filled, which casing portion is adjacent to the applicator member and has the vent passage, bears sealingly against the inside surface of the receiving space of the closure plug. When the implement to be filled is then further forced into the refilling container, the closure plug is pushed by the implement to be filled, into the refilling container, whereby the closure plug is displaced from its sealing rest position into the refilling position in which the fluid communication is formed between the interior of the refilling container and the portion, which is sealed off by the implement, of the receiving space in the closure plug. The fluid in the refilling container can then flow into the portion of the receiving space in the closure plug, which is sealed off by the implement, and from there can flow into the fluid reservoir of the implement through the vent passage which is to be found in the vicinity of the applicator member. That refilling flow can be assisted or accelerated by a pressure being repeatedly applied to, the wall of the casing. The implement is filled in an even simpler fashion if the implement is moved backwards and forwards a plurality of times axially relative to the refilling container, whereby a pump action is produced between the refilling container and the implement to be filled.

The cap-like closure plug or stopper preferably has an end portion and a sleeve or tubular portion which are integrally connected together and which define the receiving space which is open at one side. The cap-like closure plug comprises for example a relatively hard polypropylene or polyethylene material. The refilling container may comprise for example a transparent polypropylene or polyethylene material.

So that the refilling container according to the invention can repeatedly fill not just a specific form of an implement but implements of different dimensions, it is advantageous for the receiving space to be of a configuration which increases in size towards its opening. In that arrangement, the increase in size of the receiving space may be of a frustoconical configuration so that it is possible to refill virtually all implements which are of dimensions within the dimensions of the receiving space; however the receiving space of the closure plug may also be provided with axially successive spaces which are of a configuration that increases in size in a stepped manner, starting from the end portion of the closure plug. In a configuration of the last-mentioned kind, the or each space of the step-wise enlarging receiving space may be provided with a sealing lip extending therearound, in the vicinity of the corresponding step. The or each sealing lip provides a secure sealing effect for the corresponding implement which is to be refilled and which is suitably adapted to the refilling container, or the casing portion of the implement, which has the vent passage and out of which the applicator member projects. That sealing effect gives the advantage that it insures that the corresponding implement can be refilled in a clean fashion. The same purpose is served if the space which defines the opening of the closure plug is provided with a sealing lip extending therearound, in the vicinity of the opening of the closure plug or the refilling container.

As already mentioned hereinbefore, the cap-like closure plug is displaced from the sealing rest position thereof into the opened refilling position when an implement to be refilled is inserted, with its applicator member leading, into the receiving space of the closure plug, which is open at one side, until the collar-like portion of the casing, which is adjacent to the applicator member, bears against the inside surface of the receiving space in the closure plug. In order to produce a reliable movement of the closure plug from the rest position into the refilling position, by means of the implement being inserted into the closure plug, it is advantageous for the stepped transitional portion between adjacent spaces of the closure plug to be provided as a contact or pressure surface for a collar-like portion of the casing of the implement, which portion is adjacent to the applicator member of the implement. That contact or pressure surface between adjacent spaces in the stepped receiving space in the closure plug can be dimensioned as an annular surface which is perpendicular to the longitudinal centre line of the closure plug or refilling container, as a rounded-off annular surface, as an annular surface of frustoconical configuration, or the like.

Reliable sealing of the refilling container in its rest position is ensured if the neck portion of the refilling container is provided at its inside with a sealing bead or ridge which extends therearound and against which the closure plug bears slidably and sealingly. In that arrangement, the closure plug is of a cylindrical configuration on its outside, that is to say at the outward side of its neck portion, in order to guarantee a defined sliding movement. That sliding movement is further improved if the closure plug is provided at its outside with at least one sealing portion which extends therearound and which bears slidably and sealingly against the inward side of the neck portion of the refilling container. That means however that the inward side of the neck portion of the refilling container must also be of a cylindrical configuration. The sealing bead or ridge at the inward side of the neck portion of the refilling container and the sealing portion which extends around the closure plug on the outside thereof provides a secure and reliable multiple sealing effect for the refilling container in its rest position, so that the low-viscosity fluid which is stored in the refilling container is prevented from unintentionally escaping and the refilling container can be highly satisfactorily stored. The closure plug is preferably arranged in the refilling container or in the open neck portion thereof in such a way that it does not project out of the neck portion, thereby even more reliably excluding the possibility of the refilling container being unintentionally opened.

The closure plug may be provided on its outside with an abutment which, in the rest position of the closure plug, bears against the sealing lip of the neck portion and which is axially spaced from the sealing portion of the closure plug. That axially defines the rest position of the closure plug while in addition it restricts the above-mentioned pump movement, when filling an implement. For the same purpose, that is to say for axially defining the rest position of the closure plug, it is desirable if the neck portion of the refilling container is provided at its inside with an abutment which, in the rest position of the closure plug, bears against the sealing portion which extends therearound on the outside thereof. When an implement to be refilled is inserted, with its applicator member leading, into the refilling container or into the receiving space in the closure plug, until the portion of the casing of the implement which extends around and is adjacent to the applicator member comes to bear against the inside surface of the receiving space, in which case it will be appreciated that the applicator member remains at all times spaced on all sides from the inside surface of the receiving space in order reliably to prevent the applicator member from being damaged, then, when the applicator implement is further pressed into the refilling container, the abutment which is provided at the inward side of the neck portion of the refilling container is passed over, whereupon the closure plug can be moved into the refilling position or displaced with a reciprocating movement.

It has been found desirable for the closure plug to be provided with at least one through opening which is formed in the axial portion of the closure plug between its abutment and its sealing portion and which, in the rest position of the closure plug, is separated from the interior or storage space of the refilling container by the internal sealing bead or ridge on the neck portion of the refilling container, while in the refilling position the through opening forms the fluid communication between the storage space in the refilling container and the receiving space in the closure plug. It is also possible for more than one through opening to be provided along the periphery of the closure plug or its sleeve or tubular portion which projects away from the end portion of the closure plug, with the through openings being arranged for example at equal spacings.

An embodiment of the refilling container is characterized in that the closure plug is provided with an axially directed peg or spike which extends from the end portion of the closure cap into the storage space in the refilling container, and the refilling container is provided with a closure foil at its end remote from its opening, wherein in the rest position of the refilling container the peg or spike ends at a spacing in front of the closure foil and penetrates the foil in the refilling position. Such a configuration of the refilling container gives the advantage that, particularly when the refilling container is in a downwardly directed refilling position, air can flow into the storage space in the refilling container, through the hole formed by means of the peg or spike in the upward sealing or closure foil. That prevents a reduced pressure from occurring in the storage space in the refilling container, during the refilling operation, and at the same time it provides for relatively fast refilling of the implement to be refilled, which is oriented in a downwardly hanging position.

In order to insure that air can reliably flow through the opening made in the foil by the peg or spike, it is advantageous for the peg or spike to be of a profile having at least one air feed passage. For that purpose the peg or spike may be for example of a U-shaped, V-shaped, cross-shaped or any other suitable cross-sectional profile.

It will be appreciated that the at least one air feed passage does not have to extend over the entire length of the peg or spike, but on the contrary it is sufficient if the at least one air feed passage is formed at least at the front end portion of the peg or spike, which passes through the foil in the refilling position.

The peg or spike may be provided with at least one bevel to form a cutting edge or tip. The or each bevel or the tip or cutting edge may be provided with grooving or knurling to make it easier for the peg or spike to pierce the foil.

Another embodiment of the refilling container according to the invention is characterized in that the closure plug is provided with a peg or spike which projects axially away from the end portion, and the refilling container is provided, at its end remote from the opening, with a closure means which has a hole through which the peg or spike sealingly projects with an end portion, when the closure plug is in the rest position, and that the peg or spike has a recess or cut-out portion which, in the rest position of the refilling container, is in the storage space in the refilling container and which, in the refilling position of the refilling container or the closure plug, extends through the hole in the closure means of the refilling container, for the intake of air into the storage space in the refilling container. With that design configuration, the front end of the peg or spike does not need to have a cutting edge or tip which represents a certain risk of injury, in order to be able to pierce a sealing or closure foil, but rather the front end of the peg or spike, which projects beyond the closure means, may be flat or rounded so as reliably to exclude the risk of injury. In the case of the last-mentioned refilling container, air passes into the storage space in the refilling container through the recess or cut-out portion provided in the peg or spike, and through the hole in the closure means.

In the case of the refilling container of the last-described kind, with a peg or spike which passes through the closure means, it has been found advantageous for the peg or spike to project away from the end portion of the closure plug at a central position, and for the hole to be provided in the centre of the closure means. In that way it is easily possible for the parts of the refilling container to be assembled, and that has an advantageous effect in terms of its production costs.

In accordance with the invention the refilling container can be of a tube-like configuration. As already mentioned, a tube-like refilling container of that kind is simple and inexpensive to produce, which is a major advantage in relation to those refilling containers which are mass-produced articles. A further quite considerable advantage of such a tube-like refilling container is that it can produce a good pump action for refilling an implement connected to the refilling container, with the fluid carried therein.

In the case of a refilling container of the last-mentioned kind, the neck portion can be integral with the remainder of the refilling container and the refilling container can be sealed off at its end portion which is remote from the neck portion. The refilling container may comprise a sheet metal or plastic material.

Instead of the refilling container being of a one-piece construction, it is also possible for the neck portion to be provided on a first portion of the refilling container and for the first portion to be sealingly joined to a second portion.

BRIEF DESCRIPTION OF THE DRAWINGS

Embodiments of the refilling container according to the invention are illustrated in the drawings and described hereinafter. In the drawings.

DETAILED DESCRIPTION OF PREFERRED EMBODIMENTS

Figure 1:
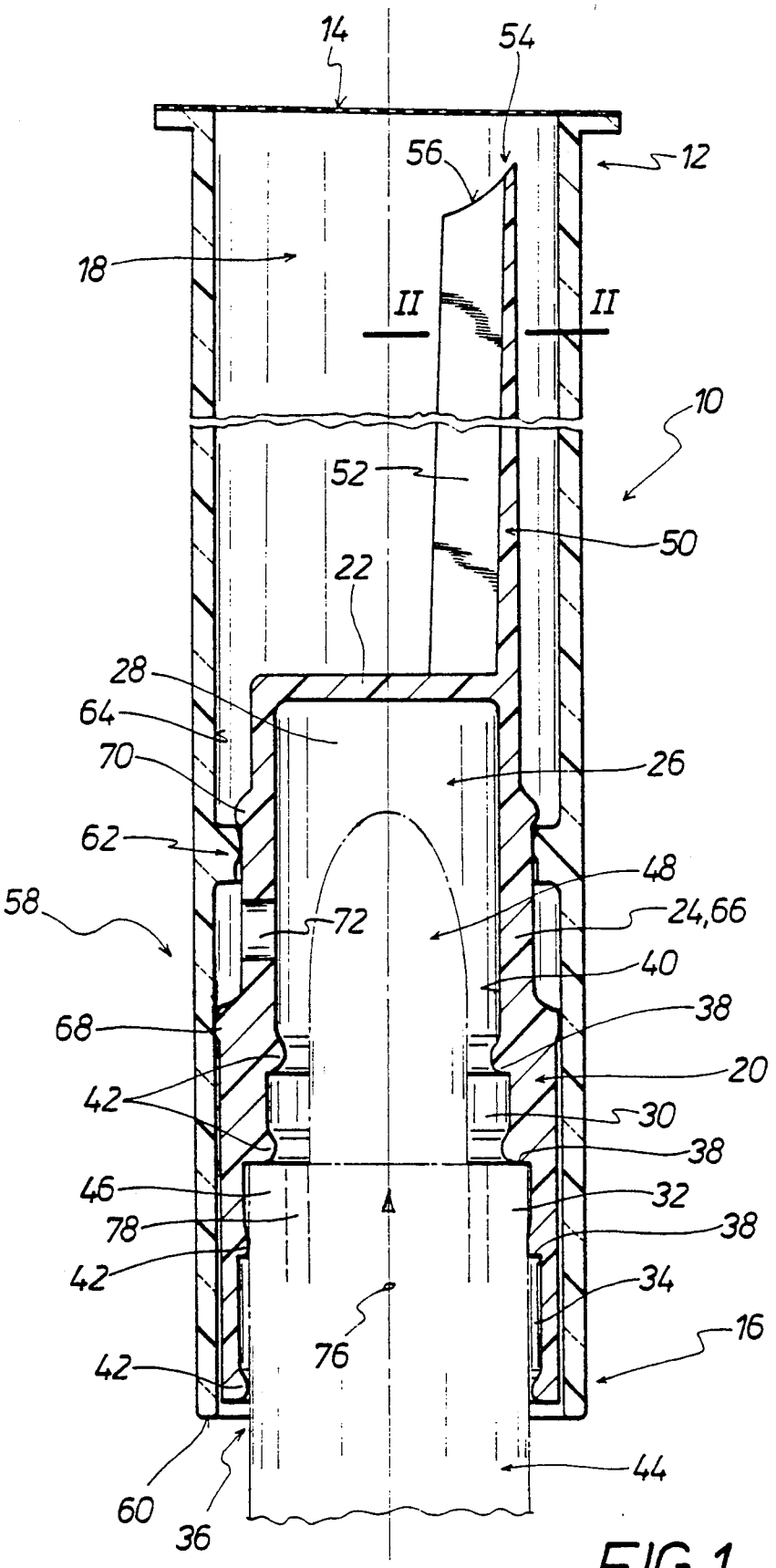
FIG. 1 is a view in longitudinal section through part of an embodiment of the refilling container with a device to be refilled, of which part is shown by thin dash-dotted lines.

FIG. 1 shows an embodiment of the refilling container 10 which is shown in an interrupted form and which is of a tubular configuration and which is sealingly closed at its one end portion 12 by means of a sealing and closure foil 14. The other end portion 16 of the refilling container 10 is open and a closure plug or stopper 20 is arranged displaceably in the axial direction therein, for sealing off the interior or storage space 18. The closure plug 20 has an end portion 22 and a sleeve or tubular portion 24 which is integrally connected to the end portion 22. The end portion 22 and the sleeve portion 24 define a receiving space 26 in the closure plug 20, which is open towards the end portion 16 of the refilling container 10. In the embodiment of the refilling container 10 shown in FIG. 1, the receiving space 16 is divided into spaces 28, 30, 32 and 34 which, from the end portion 22 of the closure plug 20 towards the end portion 16 or opening 36 of the closure plug 20, are each of a progressively increasing diameter, thus giving a receiving space 26 which increases in size in a step-wise manner. In the direct vicinity of the stepping 38 between adjacent spaces 28, 30, 32 and 34, the inside surface 40 of the sleeve portion 24 of the closure plug 20 is respectively formed with a peripherally extending sealing lip 42 to provide a secure sealing action between the closure plug 20 and an implement 44 of which part is shown in FIG. 1 in thin dash-dotted lines, when the implement 44 is inserted through the opening 36 and into the receiving space 26 in the closure plug 20, to such an extent that the portion 46 of the casing of the implement 44, out of which the applicator member 48 of the implement 44 projects, bears against the corresponding step 38. The receiving space 26 is of such a configuration that the applicator member 48 of any implement 44 which can be inserted into the closure plug 20 is sufficiently spaced from the inside surface 40 of the closure plug 20, so that any damage to the applicator member 48 when the implement 44 is being refilled is reliably prevented.

Figure 2:
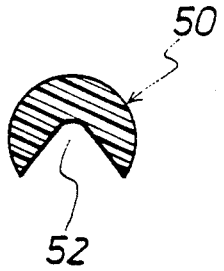
FIG. 2 is a view in section taken along section line II—II in FIG. 1 through the peg or spike which projects away from the end portion of the closure plug.
Figure 3:
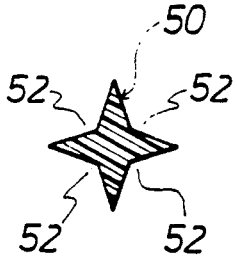
FIG. 3 is a sectional view corresponding to that shown in FIG. 2 through another embodiment of the peg or spike which projects away from the end portion of the closure plug.

A peg or spike 50 projects axially away from the end portion 22 of the closure plug 20. As can be seen from FIG. 2, the peg or spike 50 is of a U-shaped or V-shaped cross-section, thus providing an air feed passage 52. FIG. 3 shows a cross-sectional profile of a peg or spike 50 which is of a star-like or cross-like configuration, so that there are four air feed passages 52, as considered in the peripheral direction of the peg or spike 50.

The peg or spike 50 is of such an axial longitudinal extent that, in the rest position of the refilling container 10 as shown in FIG. 1, the cutting edge or tip 54 of the peg or spike 50 terminates at a small spacing in front of the foil 14 in the storage space 18 of the refilling container 10. The peg or spike 50 is formed with at least one bevel 56, in order to form the cutting edge or tip 54 thereon.

Starting from the opening 36, the refilling container 10 comprises a neck portion 58, the axial longitudinal extent of which is defined on the one hand by the annular surface 60 which defines the opening 36, and on the other hand a sealing bead or ridge 62. The sealing bead or ridge 62 projects inwardly from the inside 64 of the refilling container 10 or the neck portion 58 thereof, and it is of an inside diameter which corresponds to the outside diameter of a part 66 of the sleeve portion 24 of the closure plug 20, such that there is a sealing effect between the sealing bead or ridge 62 and the part 66, while at the same time the closure plug 20 is axially displaceable between the rest position shown in FIG. 1 and a refilling position, in relation to the neck portion 58 or in relation to the refilling container 10.

On its outside the closure plug 20 is provided with a peripherally extending sealing portion 68 which bears sealingly against the inside 64 of the neck portion 58 of the refilling container 10. At the same time, the sealing portion 68 improves the linear guidance of the closure plug 20 relative to the refilling container 10.

A passage or through-flow opening 72 is provided in the sleeve portion 24 of the closure plug 20, in the part 66 thereof which is axially defined on the one hand by the peripherally extending sealing portion 68 and on the other hand by an abutment 70 which is provided on the outside of the closure plug, As can be seen from FIG. 1, in the rest position of the refilling container 10, the abutment 70 bears against the peripherally extending sealing bead or ridge 62 and therefore limits the axial movement out of the refilling container 10.

An implement 44 to be refilled is inserted, with its applicator member 48 leading, into the receiving space 26 in the closure plug 20 until the collar-like portion 46 of the casing, out of which the applicator member 48 projects, bears snugly against a corresponding step 38. At the same time, the receiving space 28 of the closure plug 20 is sealed off by virtue of the associated sealing lip 42 which bears laterally snugly against the above-mentioned collar-like portion 46 of the casing of the implement. After that, the closure plug 20 can be pushed axially in the direction indicated by the arrow 76 by means of the implement 44 until the peripherally extending sealing portion 68 of the closure plug 20 comes to bear against the sealing bead or ridge 62. In that refilling position, the through opening 72 is on the side of the sealing bead or ridge 62 which is remote from the opening 36, that is to say, a fluid communication is made through the opening 72, between the storage space 18 and the receiving space 26, so that the low-viscosity fluid in the storage space 18 can flow through the opening 72 into the receiving space 26 and from there through the vent passage 78 which is provided beside the applicator member 48 in the implement 44 and of which only part is diagrammatically indicated in FIG. 1, into the implement 44 or into the fluid reservoir in the implement 44. So that, during the refilling operation, a reduced pressure which would impede the refilling operation or, in the extreme case, interrupt the refilling operation, does not occur in the storage space 18. The arrangement illustrated has the peg or spike 50 which projects away from the end portion 22 of the closure cap 20 and which, in the above-mentioned refilling position, pierces the foil 14 with its cutting edge or tip 54, so that when the foil 14 is pierced, air can flow through the air feed passage 52 into the storage space 18 in the refilling container 10.

Refilling of an implement 44 with a refilling container 10 of the configuration shown in FIG. 1 is possible even when the closure plug 20 does not have a peg or spike 50. In that case a suitable pump action can be produced for example by repeatedly pressing against the flexible wall of the casing of the implement 44 so that it is possible to refill the implement, even when the system defined by the implement 44 and the refilling container 10 is a closed system. When using a refilling container 10 in which the closure plug 20 does not have a peg or spike 50, an implement 44 can be filled with the fluid in the refilling container in a particularly simple fashion by the implement 44 with the closure plug 20 being repeatedly axially reciprocated, in relation to the refilling container 10.

Figure 4:
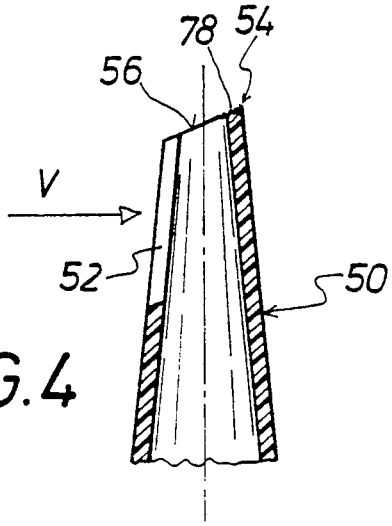
FIG. 4 is a view in longitudinal section of the front portion of a further embodiment of the peg or spike which projects away from the closure plug.
Figure 5:
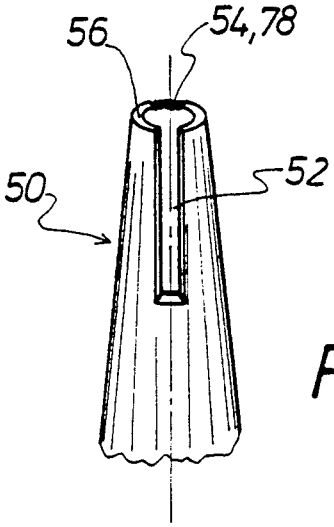
FIG. 5 is a view of the peg or spike shown in FIG. 4, looking in the direction indicated by the arrow V.

FIGS. 4 and 5 show a view in longitudinal section and a side view of a configuration of the peg or spike 50, wherein the peg or spike 50 is of a tubular configuration so that it enjoys good stability in respect of shape, while being of relatively low weight. In this construction, an air feed passage 52 is formed at the front end portion of the peg or spike. Reference numeral 56 in FIGS. 4 and 5 also identifies the bevel at the front end of the peg or spike, which forms a cutting edge 54 on the peg or spike 50. In order further to facilitate piercing of the foil 14 (see FIG. 1), the cutting edge 54 in the last-described embodiment of the peg or spike 50 is provided with grooving or knurling 78.

Figure 6:
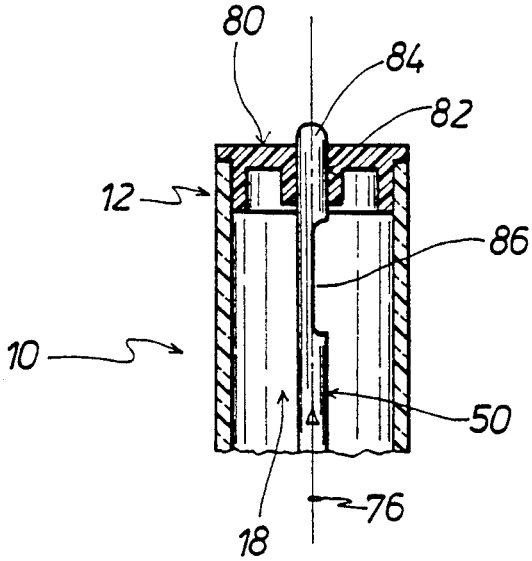
FIG. 6 shows a portion of another configuration of the refilling container, with a peg or spike which extends through a closure means of the refilling container and which projects away from the closure plug.

FIG. 6 indicates a configuration of the refilling container 10 which differs from the embodiment shown in FIG. 1, in particular in that the end portion 12 of the refilling container 10 is sealingly closed not by a foil but by a closure means 80 which has a central hole 82. In the FIG. 6 embodiment of the refilling container 10, a spike or peg 50 projects away from the closure plug 20 (see FIG. 1) at a central position. In the rest position of the refilling container 10 or the closure plug, as shown in FIG. 6, the spike or peg 50 already extends with an end portion 84 sealingly through the central hole 82 in the closure means 80. Adjoining its end portion 84, the peg or spike 50 has a recess or cut-out portion 86 which, in the rest position of the refilling container 10, is disposed in the interior of the refilling container 10 or in the storage space 18 thereof.

Upon displacement of the closure plug 20 (see FIG. 1) in the direction indicated by the arrow 76, the peg or spike 50 is correspondingly axially displaced so that the recess 86 extends through the closure means 80 so that air can flow into the storage space 18 through the central hole 82 and the recess 86.

Figure 7:
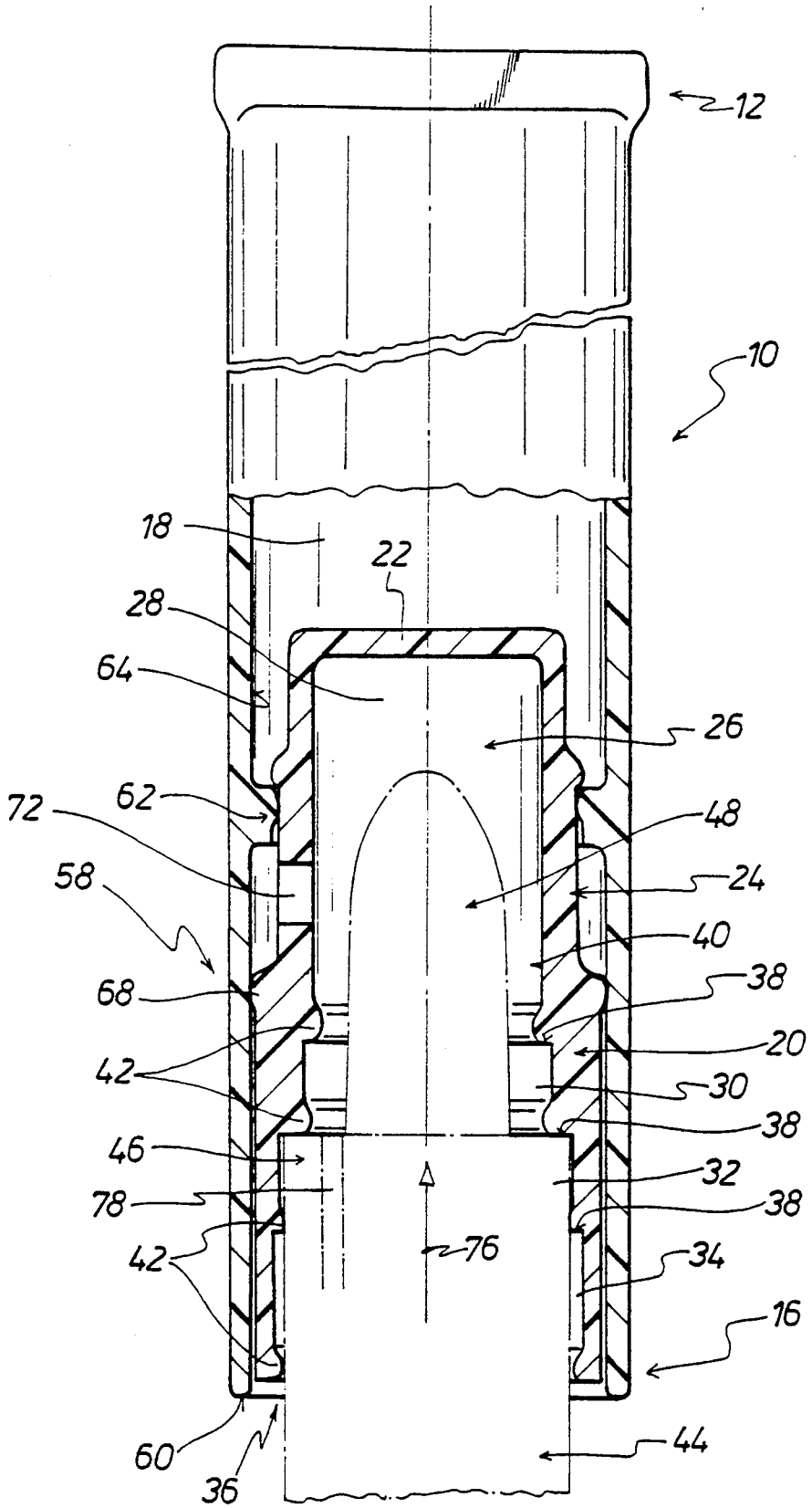
FIG. 7 is a view in longitudinal section on a greatly enlarged scale through a refilling container of which part is shown and which is of a one-piece tube-like configuration.

FIG. 7 shows a tube-like refilling container 10 whose first end portion 12 is sealingly closed off. That can be done by folding over and/or by welding. The second end portion 16 of the tube-like refilling container is open, that is to say it has an opening 36. The opening 36 of the refilling container 10 is closed by means of a closure plug or stopper 20 and is sealed off in the normal rest position. The closure plug 20 defines in the container 10 an internal or storage space 18 which contains a relatively low-viscosity fluid which serves to refill an implement 44 which is indicated in FIG. 7 by thin dash-dotted lines. The implement 44 which is for example a writing, painting or drawing implement, a cosmetic applicator implement or the like, comprises an applicator member 48 which projects from the portion 46 of the casing of the implement. In the vicinity of the applicator member 48 which has a capillary conveying action, a vent passage 78 extends through the casing portion 46 into the implement 44 or into a fluid reservoir (not shown) in the implement. An implement 44 to be refilled can be refilled with the fluid in the refilling container 10, through the above-mentioned vent passage 78.

The closure plug or stopper 20 is of a cap-like configuration having an end portion 22 and a tubular or sleeve portion 24 which projects away from the end portion 22, thereby providing a receiving space 26 for the front portion of the implement 44 or its applicator member 48, and the casing portion 46 which adjoins the applicator member 48.

In order to be able to refill implements 44 of different configurations, with the tube-like refilling container 10, the receiving space 26 comprises spaces 28, 30, 32 and 34 which increase in size in a stepped configuration, that is to .say they are of progressively increasing diameters, in a direction away from the end portion 22 towards the opening 36. Formed at the steps 38 of the spaces 28, 30, 32 and 34 are peripherally extending sealing lips 42 which project inwardly from the respective inward surfaces 40. When an implement 44 to be refilled is inserted into the receiving space 26 in the closure plug 20, the casing portion 46 from which the applicator member 48 projects comes to bear against a step 38. At the same time, at least one sealing lip 42 produces a sealing action between the receiving space 26 and the refilling container 10 and the implement 44, in relation to the ambient atmosphere. When the implement 44 which is sealingly inserted into the receiving space 26 in that way is then pushed further into the tube-like refilling container 10 in the direction indicated by the arrow 76, the closure plug 20 is pushed into the refilling container 10 until a peripherally extending sealing bead or ridge 62 which projects inwardly at the inward side 64 of the tube-like refilling container 10 or its neck portion 58 prevents a further displacement of the closure plug 20 or a peripherally extending sealing portion 68 of the closure plug 20. When the closure plug 20 is in the refilling position which is then reached, a fluid communication is formed between the internal or storage space 18 and the receiving space 26 in the closure plug 20, through a through opening 72 in the closure plug 20, so that, by compressing the wall of the implement 44 and/or in particular by compressing the tube-like refilling container 10, it is possible to produce a pump action by means of which the fluid in the storage space 18 is pumped through the vent passage 78 into the reservoir (not shown) of the implement 44 and the implement 44 is refilled with the fluid.

FIG. 7 shows a refilling container 10 in the form of a flexible tube which is of a one-piece configuration, that is to say in which the neck portion 58 forms a single unit with the remainder of the refilling container 10. In comparison therewith, FIG. 8 indicates a refilling container 10 comprising a first portion 88 and a second portion 90 which are sealingly connected together along a peripherally extending joining portion 92, The first portion 88 comprises the neck portion 58 in which the cap-like closure plug 20 is displaceable between the rest position shown in FIG. 14 and a refilling position. The closure plug 20 is of a similar configuration to the closure plug shown in FIG. 7 so that there is no need for it to be described again in detail at this point.

In order to ensure that, after termination of a refilling operation, the closure plug 20 is not pulled out of the tube-like refilling container 10, the neck portion 58 has a flanged edge 94.

Figure 8:
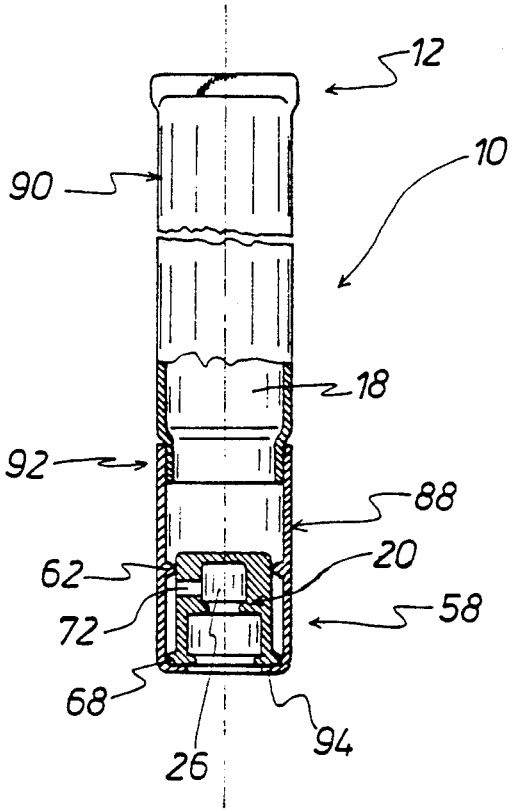
FIG. 8 is a partly sectional side view of a portion of a refilling container which is of a two-part configuration, comprising a first portion and a second portion.

The embodiment of the tube-like refilling container 10 shown in FIG. 8 also provides that the refilling position of the closure plug 20 is defined by the peripherally extending sealing bead or ridge 62 on the first portion 88 and the peripherally extending sealing portion 68 on the closure plug 20. Reference numeral 72 in FIG. 8 also identifies the at least one through opening which is provided in the closure plug 20 in order to make a fluid communication in the refilling position between the interior or storage space 18 in the tube-like refilling container 10 and the receiving space 26 of the cap-like closure plug 20.

The first end portion 12 of the tube-like refilling container 10 is either folded over a plurality of times or pressed together and welded, in per se known manner, in order to seal off the refilling container 10 at the first end portion 12.

We claim:

1. A refilling device for refilling a writing, painting or drawing implement, a cosmetic applicator implement or the like, which comprises:

a casing;

an implement to be refilling including an applicator member which projects out of the casing and which has a capillary conveying action for a fluid of relatively low viscosity, wherein the casing adjoins the applicator member;

a reservoir for the fluid which is in fluid communication with the applicator member;

a vent passage in the vicinity of the applicator member;

a refilling container having a neck portion thereof;

a plug element which projects into the refilling container in the neck portion;

wherein, the implement to be refilled can be inserted with the applicator member and the casing portion into the plug element such that a sealing is made between the neck portion of the refilling container, the plug element and said casing portion and a fluid communication is made through the vent passage between the refilling container and the reservoir in the implement;

wherein the plug element is in the form of a cap-like closure plug having an end portion, with the closure plug oriented into the refilling container and which is slidably displaceable between a rest position sealing off the refilling container and a refilling position providing a fluid communication between the interior of the refilling container and a receiving space in the closure plug, which is open at one side, wherein the closure plug is provided for accommodating the applicator member and at the same time for sealingly receiving a portion of the casing of the implement to be refilled, said casing portion being adjacent to the applicator member and having said vent passage;

wherein the receiving space is of a configuration which enlarges towards said open side, with the receiving space comprising an axial succession of spaces which are of a configuration which enlarge in a step-wise manner, starting from the end portion of the closure plug, with stepped transitional portions between adjacent spaces and with each stepped transitional portion provided as a contact or pressure surface for a portion of the casing of the implement, which portion is adjacent to the applicator member of the implement to be refilled.

2. A refilling device according to claim 1 wherein the neck portion of the refilling container is provided at its inside with a peripherally extending sealing bead against which the closure plug slidably and sealingly bears.

3. A refilling device according to claim 2 wherein on its outside the closure plug has at least one peripherally extending sealing portion which bears slidably and sealingly against the inside of the neck portion of the refilling container.

4. A refilling device according to claim 3 wherein the interior of the refilling container includes a storage space and wherein the closure plug has an axial portion with an abutment and with at least one through opening which is formed in the axial portion of the closure plug between the abutment and peripherally extending sealing portion, and which in the rest position of the closure plug is separated from the storage space of the refilling container by said sealing bead on the neck portion of the refilling container and in the refilling position the through opening forms the fluid communication between the storage space of the refilling container and the receiving space of the closure plug.

5. A refilling device according to claim 4 wherein the refilling container has an opening and an end portion remote therefrom and the closure plug is provided with an axially oriented peg which extends from the end portion of the closure plug into the storage space of the refilling container, and wherein at the end portion of the refilling container which is remote from the opening of the refilling container, the refilling container is provided with a foil, wherein in the rest position the peg ends at a spacing in front of the foil while in the refilling position the peg passes through the foil.

6. A refilling device according to claim 4, wherein the refilling container has an opening and an end portion remote therefrom and the closure plug is provided with a peg which projects axially away from the end portion of the closure plug, and the refilling container is provided at its end portion remote from the opening of the refilling container with a closure means having a hole through which the peg sealingly extends with an end portion thereof when the closure plug is in the rest position, and wherein the peg has a recess which in the rest position of the closure plug is in the storage space of the refilling container and which in the refilling position passes through the hole in the closure means of the refilling container for intake of air into the storage space.

7. A refilling device according to claim 1 wherein the refilling container is of a tube-like configuration.

* * * * *